United States Patent [19]

Tice

[11] Patent Number: 4,889,441

[45] Date of Patent: Dec. 26, 1989

[54] SKIN LOTION DISPENSER AND APPLICATOR

[76] Inventor: Janell Tice, 21500 Lassen St., Chatsworth, Calif. 91311

[21] Appl. No.: 180,239

[22] Filed: Apr. 11, 1988

[51] Int. Cl.[4] ..... A45B 34/00; A46B 11/02

[52] U.S. Cl. ..... 401/131; 401/6; 401/140; 401/183; 401/186; 401/205; 401/207

[58] Field of Search ..... 401/183, 186, 131, 207, 401/205, 140, 6

[56] References Cited

U.S. PATENT DOCUMENTS

| | | | |
|---|---|---|---|
| 1,571,254 | 2/1926 | Foote | 401/131 |
| 2,820,234 | 1/1958 | Rigney | 401/186 |
| 3,187,365 | 6/1965 | Paul | 401/207 X |
| 3,390,940 | 7/1968 | Swartzman | 401/186 |
| 4,451,164 | 5/1984 | Roberts, Jr. | 401/196 |
| 4,693,623 | 9/1987 | Swartzman | 401/186 X |

FOREIGN PATENT DOCUMENTS

| | | | |
|---|---|---|---|
| 844808 | 7/1952 | Fed. Rep. of Germany | 401/183 |
| 2151195 | 4/1973 | Fed. Rep. of Germany | 401/183 |
| 2206247 | 8/1973 | Fed. Rep. of Germany | 401/183 |
| 429069 | 7/1967 | Switzerland | 401/196 |

*Primary Examiner*—Steven A. Bratlie
*Attorney, Agent, or Firm*—Roger A. Marrs

[57] ABSTRACT

A combined skin lotion dispenser and applicator is disclosed herein having an elongated tube containing a quantity of lotion which is of thin walled construction so as to be manually squeezed to forceably urge the lotion through a one-way closure valve into a rigid applicator member of a paddle type. The member includes a row of openings of different diameters arranged in fixed apart spaced relationship on a convex arcuate section. The member is covered with a removable mitt or fabric bag intended to be saturated with the dispensed lotion. A detachable base is provided for supporting the applicator on a surface and a tote or carrying bag is employed for storing the applicator during transport.

2 Claims, 1 Drawing Sheet

SKIN LOTION DISPENSER AND APPLICATOR

BACKGROUND OF THE INVENTION

1. Field of the Invention

The present invention relates to dispensers and applicators and more particularly to a novel combined dispenser and applicator for holding a quantity of skin lotion or liquid that may be readily squeezed to present a quantity of the lotion or liquid to an applicator head or member for direct application to the skin of the user.

2. Brief Description of the Prior Art

In the past, it has been the conventional practice to apply skin lotion or liquid by emptying a quantity of the liquid from a container into the hand of the user followed by rubbing or splashing the lotion or liquid about the skin of the user with the hands. Although such practice provides a means for applying the liquid or lotion to the arms, legs and front of the torso, difficulties are had by an individual trying to apply the lotion or liquid to the shoulders and back since they are difficult to reach and apply the skin product thereto.

Although some attempts have been made to provide an applicator, a variety of problems and difficulties have been encountered which stem largely from the fact that it is difficult to apply the oily lotion of a suntan type to the applicator without spillage or leaving the hands of the user messy. Also, the usual applicators are substantially rigid and involve complex pivoting joints and expensive molded applicator components. Lotion applicators which have been found in the prior art are represented by U.S. Pat. Nos. 4,396,028; 4,171,171 and 4,299,005. Such prior devices are awkward to use, do not control the dispensing of a predetermined quantity of lotion and are relatively expensive to manufacture and use.

Therefore, a longstanding need has existed to provide a novel combined dispenser and applicator for a skin product lotion or liquid which includes means for limiting the dispensing of the liquid and which permits direct application of the liquid or lotion to the skin of the user in difficult to reach skin areas. Such a device should include fixed components which are not required to pivot or move with respect to one another and such a device should be self-supporting when not in use.

SUMMARY OF THE INVENTION

Accordingly, the above problems and difficulties are obviated by the present invention which provides a novel combined dispenser and applicator for a skin product of a liquid or oil lotion-type that comprises an elongated container adapted to be hand held which is of thin-walled construction. One end of the handle is substantially cylindrical while the other end is in a tapered, conical configuration terminating in an integral valve means permitting a quantity of the contained liquid or lotion to be passed upon squeezing the thin sidewalled handle. A rigid applicator of a paddle-type is removably connected to the conical end of the handle and is in fluid communication with the interior of the handle via the one-way valve means. The applicator is provided with a plurality of spaced apart outlets or holes through which the lotion or liquid will exit the device upon passage through the valve means. A cloth or fabric mitt or cover is removably carried about the applicator so that the lotion or oil may be spread over a large area for direct contact to the skin of the user. A feature also resides in the fact that the applicator or head is curved so as to be substantially conformal to the skin of the user.

Therefore, it is among the primary objects of the present invention to provide a novel combined skin product lotion or oil that not only contains a quantity of the product but provides an applicator for spreading the product on the skin of the user even in hard to reach locations.

Another object of the present invention is to provide a combined skin lotion or oil holder, dispenser and applicator which will readily dispense the oil or liquid upon the squeezing of the holder so that a controlled quantity of the product is introduced to the applicator for spreading on the skin of the user without pouring or depositing the oil or lotion into the hand of the user.

Still another object of the present invention is to provide a novel combined skin product dispenser and applicator which is self-contained and may be supported by itself on a flat surface and that may be readily transported in a carrying bag or case from place to place.

Still a further object of the present invention is to provide a novel combined skin lotion applicator and dispenser which is economical to manufacture and which is of substantially a one-piece construction without moving parts such as pivots or rotating members.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
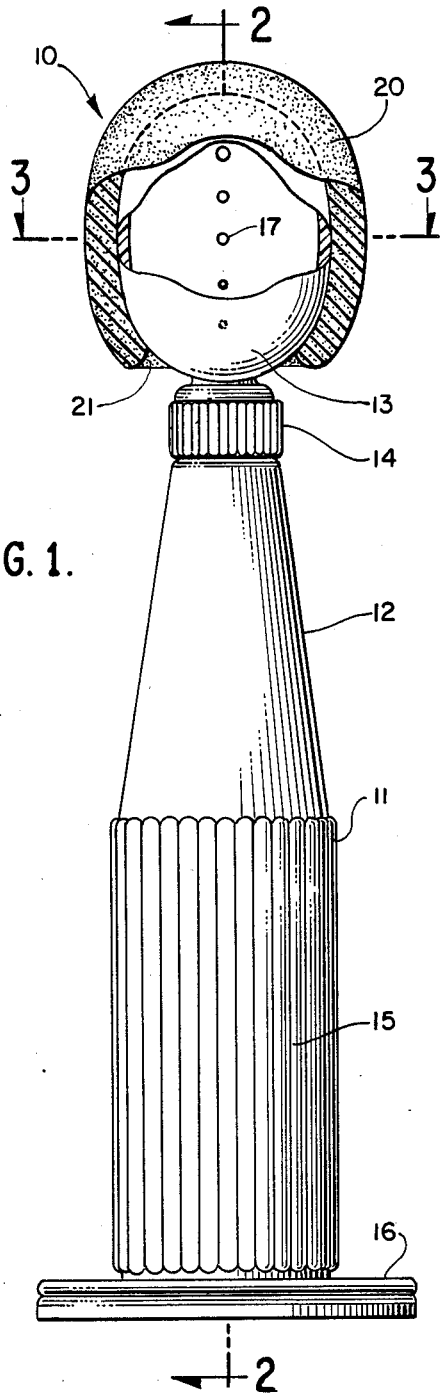
FIG. 1 is a front elevational view of the novel combined skin product dispenser and applicator incorporating the present invention.

Referring to FIG. 1, the novel combined dispenser and applicator of the present invention is illustrated in the general direction of arrow 10. The dispenser portion of the invention includes a cylindrical portion 11 which terminates in a tapering conical portion 12 on which an applicator 13 is carried by means of a threaded coupler 14. The external surface of the cylindrical dispenser portion 11 is provided with a corrugated or ridged surface indicated by numeral 15 whereby the dispenser portion may be readily gripped or handled by the hands of the user. In essence, the dispenser portions 11, 12 and the applicator 13 constitute an elongated handle whereby the dispenser and applicator may be positioned about the body of the user for dispensing of a skin lotion or product directly to the skin of the user.

FIG. 1 further illustrates that the combined dispenser and applicator may be supported in an upright position by a base 16 and that the applicator 13 comprises a head or member of a paddle-type which is hollow and is in fluid communication with the interior of the dispensing portion of the device. The applicator 13 includes a plurality of spaced apart holes or apertures such as aperture 17 through which the skin product, lotion, liquid or oil exits from the unit. It is to be noted that the apertures are arranged in a vertical row and they are of different diameters with the largest diameter at the top and the smallest diameter at the bottom of the row. Furthermore, the applicator head or member 13 is substantially covered by a mitt or cover 20 taking the form of a sleeve of close meshed fabric or of a spongy plastic material that may be readily stretched and slid over the top of the applicator head or member 13. The cover or mitt 20 is provided with an opening such as indicated by numeral 21 through which the applicator head or member may be inserted prior to application or use of the device by the user. When the skin product, lotion or oil has been saturated in the cover or mitt 20, application directly to the skin can take place. The cover or mitt 20 may be removed and cleaned after usage of the device. Although the applicator 13 is illustrated as having a broad face or applicator surface as shown in FIG. 1, it is to be understood that the applicator may take other decorative forms.

Figure 2:
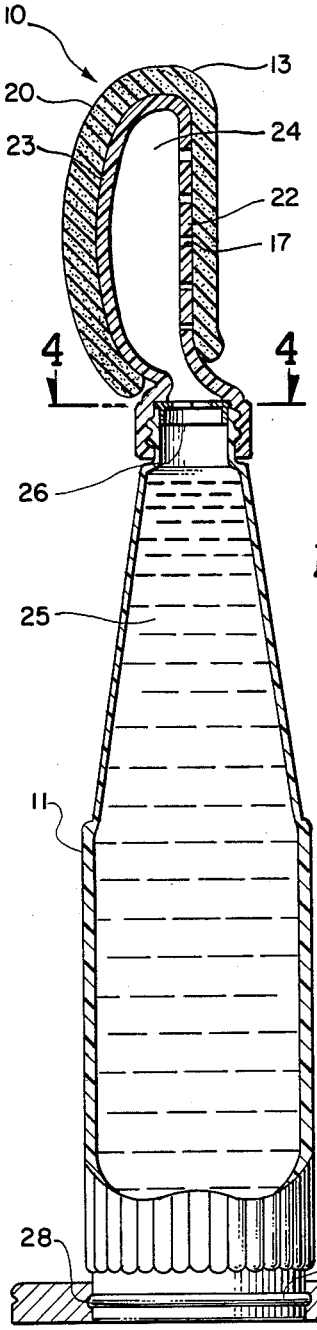
FIG. 2 is a longitudinal cross-sectional view of the combined dispenser and applicator shown in FIG. 1 as taken in the direction of arrows 2—2 thereof.

In FIG. 2, the applicator 13 is more clearly illustrated as having a front applicator wall 22 containing the plurality of holes aligned in a row. The opposite wall of the applicator is identified by numeral 23 and is illustrated as being in a convex arcuate shape in cross-section wherein the opposing surfaces of the walls 22 and 23 define a storage cavity 24 intended to be occupied by the skin product prior to passage through the openings into the mitt or cover 20. The skin product is indicated by numeral 25 stored within the interior of the dispensing portion 11 and the interior of the dispensing portion 11 is separated from the cavity 24 of the applicator by means of a one-way valve 26. Preferably, the valve means 26 is of a flap type wherein pressure on either side of the flap will cause passage of the fluid therethrough. Since the sidewall of the dispensing portion 11 is thin, manual squeezing of the sidewall will force the contents 25 through the flaps of the valve means 26 into the cavity 24. The contents will then pass through the row of apertures, such as aperture 17, to saturate the cover or mitt 20. The configuration of the walls 22 and 23 of the applicator 13 is intended to be substantially conformal to the surface of the skin generally throughout the surface of the user's body so that direct application of the skin product thereto may be accommodated.

It is also to be noted that the base 16 is detachably connected to the end of the dispensing portion 11 from its end threadably connected to the applicator 13. One means of detachably connecting the base to the dispensing portion 11 is by providing a snaplock arrangement between an annular bead 27 intended to snap fit with an annular groove 28 provided in a bore through the center of the base 16. Therefore, the base need not be handled during the procedure for applying the skin product to the skin of the user, but the stand or base can be used when the combined dispenser-applicator combination is at rest on a counter or supporting surface.

Figure 3:
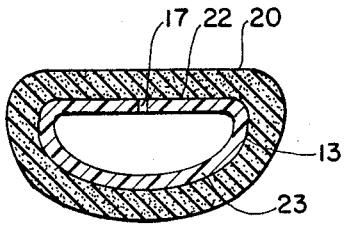
FIG. 3 is a transverse cross-sectional view of the combined dispenser and applicator shown in FIG. 2 as taken in the direction of arrows 3—3 thereof.

FIG. 3 clearly shows that the shape of the applicator sidewalls 22 and 23 are substantially different in that wall 22 is substantially flat and broad while the wall 23 is substantially arcuate in cross-section.

Figure 4:
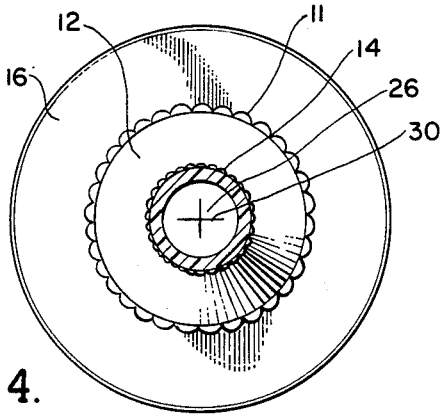
FIG. 4 is a transverse cross-sectional view of the applicator carried on the dispenser shown in FIG. 2 as taken in the direction of arrows 4—4 thereof.

Referring to FIG. 4, the one-way valve 26 is illustrated which may take the form of a diaphragm which is provided with crosscuts 30. The diaphragm may be of a disc-type which is disposed between the end of the tapered portion 12 of the dispenser unit 11 and a shoulder carried at the bottom of the threaded recess of the cap coupler 14 carried on the applicator 13.

Therefore, it can be seen that the novel combined dispenser and applicator of the present invention provides an economical and efficient means for applying a skin product to the skin of the user and even to areas which are hard to reach. The user merely squeezes the thin-walled sidewall of the dispensing portion 11 so that the contents pass through the one-way valve into the cavity 24 of the applicator 13. The amount dispensed is under the control of the user so that wastage is avoided. The lotion or skin care product goes through the holes or apertures into the fabric or sponge mitt 20 and then directly to the skin of the user. In one form of the invention, the apertures may be placed along the flat surface or wall 22 while an option resides in providing the apertures on the arcuate wall 23 as well or independent of the apertures on the wall 22.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A combination dispenser and applicator for a liquid skin care product comprising:

an elongated hollow handle composed of flexible material having a cylindrical portion supporting a conical, tapered portion;

said cylindrical portion having a thicker cross-section than that of said conical portion;

said handle holding a quantity of liquid skin care product and the sidewalls thereof being thin-walled to permit manual squeezing thereof to expel said skin care product through a dispensing nozzle at the apex end of said conical portion;

a one-way valve carried on said apex end allowing passage of said skin care product externally of said dispenser nozzle in response to said manual squeezing;

an applicator removably carried on one end of said handle about said dispensing nozzle for receiving said skin care product via said one-way valve when said thin-walled handle is squeezed;

said handle having an exterior surface about said cylindrical portion provided with a plurality of parallel ridges constituting frictional, non-slip finger-gripping means;

a base removably carried on the end of said handle opposite to its end carrying said applicator supporting said handle in an upright at rest or storage position;

said applicator comprising an oval-shaped hollow member having opposite spaced-apart walls joined at their ends by curved sections, a selected one of said walls provided with a plurality of spaced-apart openings extending in a vertical linear line midway between said curved sections for dispensing said skin care product therethrough externally of said handle;

each of said openings being of a different diameter with the largest diameter opening at the top of said line and the smallest diameter at the bottom of said line; and said openings operable to control the flow through said dispensing applicator member.

2. The invention as defined in claim 1 including:

a porous cover removably carried over said applicator member in lotion receiving communication with said openings.

* * * * *